US006540048B1

(12) United States Patent
Müller

(10) Patent No.: US 6,540,048 B1
(45) Date of Patent: Apr. 1, 2003

(54) ELEVATOR INSTALLATION WITH HOISTWAY DOORS

(75) Inventor: Rolf Müller, Shizuoka (JP)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/614,672

(22) Filed: Jul. 12, 2000

(30) Foreign Application Priority Data

Jul. 12, 1999 (EP) ..... 99810621

(51) Int. Cl.[7] ..... B66B 13/08
(52) U.S. Cl. ..... 187/325; 52/30
(58) Field of Search ..... 187/313–324, 187/325; 52/30

(56) References Cited

U.S. PATENT DOCUMENTS

| | | | | |
|---|---|---|---|---|
| 3,741,351 A | | 6/1973 | Suozzo | |
| 4,122,685 A | * | 10/1978 | Ruff | 52/30 |
| 4,489,527 A | * | 12/1984 | Haas | 52/217 |
| 4,819,403 A | | 4/1989 | Penicaut et al. | |
| 4,896,747 A | * | 1/1990 | Inglis | 187/1 R |
| 5,012,621 A | * | 5/1991 | Prewer et al. | 52/30 |
| 5,479,754 A | * | 1/1996 | Pelvilain et al. | 187/408 |
| 5,560,165 A | * | 10/1996 | Hoefsloot et al. | 52/210 |
| 6,145,630 A | * | 11/2000 | Friedman et al. | 187/313 |

FOREIGN PATENT DOCUMENTS

| | | | |
|---|---|---|---|
| EP | 0 475 074 | | 3/1990 |
| EP | 0 606 508 | | 7/1994 |
| FR | 2 247 415 | | 5/1975 |
| JP | 8-12236 | * | 1/1996 |
| JP | 10-231065 | * | 9/1998 |

* cited by examiner

*Primary Examiner*—Thomas J. Brahan
(74) *Attorney, Agent, or Firm*—MacMillan, Sobanski & Todd, LLC

(57) ABSTRACT

An elevator installation with hoistway doors has door panels that can be laterally displaced beyond the width of the hoistway, and/or they can be at least partially displaced into the hoistway wall resulting in an elevator installation with improved utilization of building space, which also requires less effort to install. The door frame of the hoistway door assembly is transformed into a flat, wide hoistway wall module with integral hoistway doors such that building space hitherto required in the hoistway by the hoistway wall is reduced. The hoistway wall module is either inserted between the landing floors, or else several such hoistway wall modules are fitted together vertically and form a largely freestanding modular hoistway wall which forms between the elevator installation and the building an interface which is either self-supporting or supported individually on each floor.

18 Claims, 6 Drawing Sheets

ELEVATOR INSTALLATION WITH HOISTWAY DOORS

BACKGROUND OF THE INVENTION

The present invention relates to an elevator installation with hoistway doors laterally displaceable beyond the width of the hoistway and/or partially displaceable into the hoistway wall.

The ever increasing price and scarcity of building land necessitate high-density building with multiple stories. If vertical transportation is to be handled by an elevator installation, there is also generally little space available for the hoistway of the elevator installation. This is the starting point for deciding on the size of the elevator car and the appropriate type of elevator. When selecting the car there is frequently an associated wish or specification for the dimensions of the openings for the car or entrance to be as large as possible. Coupled with this, moreover, is the selection of car doors and hoistway doors and the overtravel distance at the side of the car required for the lateral displacement of the door panels to open the doors. The overtravel is usually less than the width of the door panels used. For a given width of car opening, the overtravel distance required defines the minimum distance of the side walls of the hoistway from each other, i.e. the hoistway width.

For preference, hoistway doors are regularly provided with two or four door panels. A feature of telescopic doors is that the length of lateral overtravel they require is small in relation to the width of the car entrance opening to be closed. The telescopic doors are, as known for example from the European patent document 0 606 508 A1, fitted as a hoistway door assembly into an opening for hoistway doors provided in the hoistway wall.

Hitherto, the hoistway door assembly has comprised a door frame which has two side jambs joined above by a transverse element, the head jamb, and below by a sill plate, and which is anchored by several fastening elements into the hoistway wall and landing floor. Fastened to the head jamb is the motive mechanism of the hoistway doors, which itself projects into the hoistway between the hoistway wall and car door in the same way as the sill plate and door panels. Furthermore, by means of the adjustable fastening elements of the hoistway door assembly, dimensional inaccuracies in the building structure are adapted to the tight dimensional specifications of the elevator installation. Especially with respect to a positionally exact alignment of the hoistway doors themselves, and relative to the car doors on each stopping floor, this has so far been associated with great effort. The adjustment range requires additional building space for the hoistway.

This total amount of hoistway space which is taken up by the parts of the hoistway door either increases the building costs or decreases the entrance area in front of the hoistway door on each landing, which for aesthetic and safety reasons should be made as spacious as possible.

SUMMARY OF THE INVENTION

The present invention concerns an elevator hoistway door assembly in the form of a hoistway wall module. An objective of the present invention is to propose an elevator which is simple to install and has improved utilization of building space by comparison with the installations described above.

According to the present invention, this objective is achieved by an elevator installation with a hoistway door which is particularly distinguished by the door panel, or the door panels, being arranged so as to be laterally displaceable beyond the width of the hoistway, and/or the door panel, or door panels, being at least partially displaceable into the hoistway wall.

According to the present invention, the available building space is optimally utilized. To increase traffic capacity, better utilization of the cross-sectional surface of the hoistway is achieved because components of the hoistway door assembly hitherto arranged in the hoistway space, as the sill plate, the door panels, and their motive mechanism, are at least partially integrated into other parts of the building structure which are necessary and present, such as for example the hoistway wall, the adjacent hoistway wall, or areas of the building structure which are integrated into the entrance area.

Because of this, and leaving the car unchanged, the elevator hoistway can be constructed narrower since the door panel(s) are at least partially laterally displaceable beyond the dimensional width of the hoistway, and the lateral hoistway door overtravel no longer represents a dimensional and constructional restriction. Elimination according to the present invention of the lateral door over travel also creates the possibility of replacing telescopic doors having two, three, or four panels, used hitherto for reasons of reducing the hoistway space, by a hoistway door with only one correspondingly wide door panel as standard and largely irrespective of the size of the car opening. This changeover to a constructionally more simple and less expensive hoistway door according to the invention is also advantageous in that it can be built into significantly less depth. According to the present invention the entrance threshold to be passed through when entering and leaving the car formed by the car door and hoistway door being held open can be constructed narrower. As well as this aesthetic enhancement of the hoistway door, installation of the hoistway doors is simpler overall. By comparison with the conventionally used narrow door panels of telescopic doors, the single, wide door panel can be aligned in its installed position in less time, whereas its dimensional accuracy lasts longer.

As a second means of solution according to the present invention, the door panel, or door panels, of the hoistway door assembly are arranged to be at least partially displaceable into the hoistway wall either in addition to, or as an alternative to, enlargement of the lateral overtravel. With the solution provided by the present invention, the large depth of building occupied hitherto by the parts of the hoistway door assembly built into the hoistway can be used for a car with larger dimensions, and/or the dimensions of the hoistway can be reduced by the amount saved.

In a further development of the present invention the car doors are also displaceable beyond the width of the hoistway, and the lateral boundaries of the hoistway have corresponding recesses formed over the entire hoisting travel of the elevator car. Running in each of these vertical grooves are the parts of the car door which project at the sides, as for example the car door sill plate and door drive. Here too, building space in the hoistway is compensated by the hoistway wall.

According to a preferred further development of the present invention, the door frame of the hoistway door assembly is made flat and wide and covers the elevator hoistway beyond the width of the hoistway up to the building structure. This so-called hoistway wall module is advantageously located and anchored between the individual stories. This makes it possible to dispense with a hoistway wall formed by the building. The hoistway wall module serves as a hoistway construction, and at the same time as a fastening construction for the hoistway door mountings. The hoistway wall module can be pre-assembled; i.e. transported to the job site with integrated hoistway door mountings. At the job site it is easy to install it in one piece and align it relative to the elevator car.

According to a preferred embodiment, the entire door assembly, meaning the hoistway wall module with integral hoistway door, is placed on the landing wall adjacent to the hoistway on both sides and covers the hoistway door opening. The hoistway wall module stands completely in the area of the landing floor and replaces a hoistway wall with restricted door cutouts usually provided in the building. If conditions in the building are suitable, hoistway door panels of any width can be used, in the extreme case having the width of the car cutout opening.

The hoistway wall module can be constructed either as a single-piece prefabricated construction of shaped metal sheets, or of wooden or plastic materials or combinations thereof. However, it can also take the form of a metal construction built up from several assemblies.

Irrespective of the form of construction, the hoistway doors are completely pre-assembled, ready to function, and fastened to the hoistway wall module. The flat, wide, and self-supporting construction of the hoistway door module creates the precondition for a construction with significantly less building depth relative to a landing wall. The large hoistway door made possible by elimination of the lateral boundary affords advantageous building space relative to the depth of the hoistway module; there is no longer a telescopic door with door panels which slide over each other.

The present invention is developed further in that two or more of the hoistway wall modules according to the invention are arranged vertically on top of each other into an essentially self-supporting hoistway wall. This modularly constructed hoistway wall rests on a hoistway pit module that serves as a foundation for hoistway and elevator. Reference points defined in the hoistway pit module determine the exact position of the first hoistway wall module, on top of which further hoistway wall modules can be easily aligned with positional accuracy. Overall, the modularly constructed hoistway wall according to the invention is largely independent of the building structure, and forms an adjustably dimensioned connecting element between the building structure and the elevator installation to compensate the dimensional tolerances.

In principle, as a self-supporting construction, the modular hoistway wall is preferably connected to the respective landing floor by only two one-dimensional fastening devices per hoistway wall module. In an embodiment for multistoried building structures, provision is made for supporting weight forces of the hoistway wall modules on the landing floors of the individual stories by means of suitable fastening elements. In both variant embodiments of the modular hoistway wall, lateral anchor fastenings in the hoistway wall can be dispensed with, which significantly counteracts sound from the motive mechanism of the door being structurally borne into the building structure.

It is advantageous for both fastening devices to be situated exclusively in the middle area of the hoistway door cutout because it is then easy to install them from the landing floor. Furthermore, this position is favorable for aligning the fastening devices as reference points and mountings when aligning the hoistway wall modules exactly plumb and aligned with the hoistway pit module by means of a laser adjustment device that in itself is known.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
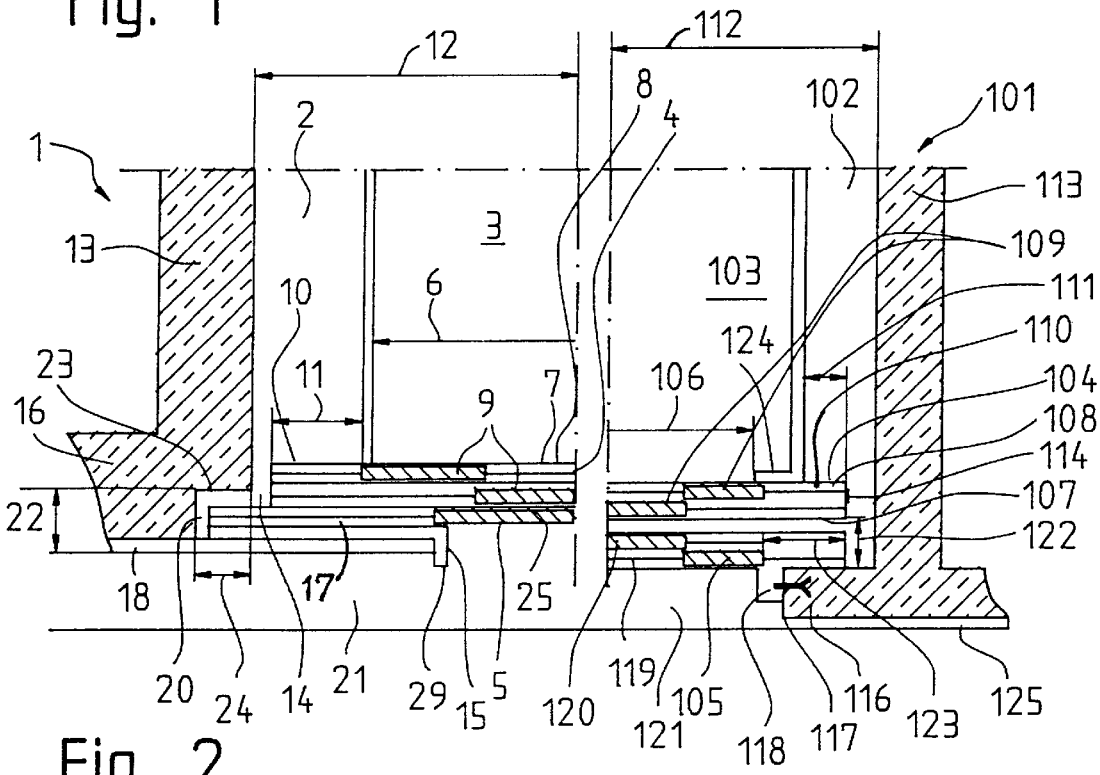
FIG. 1 is a partial sectional view of a first exemplary embodiment of the elevator installation according to the present invention side by side with a conventional elevator installation, both on a horizontal plane at the level of a hoistway door.
Figure 2:
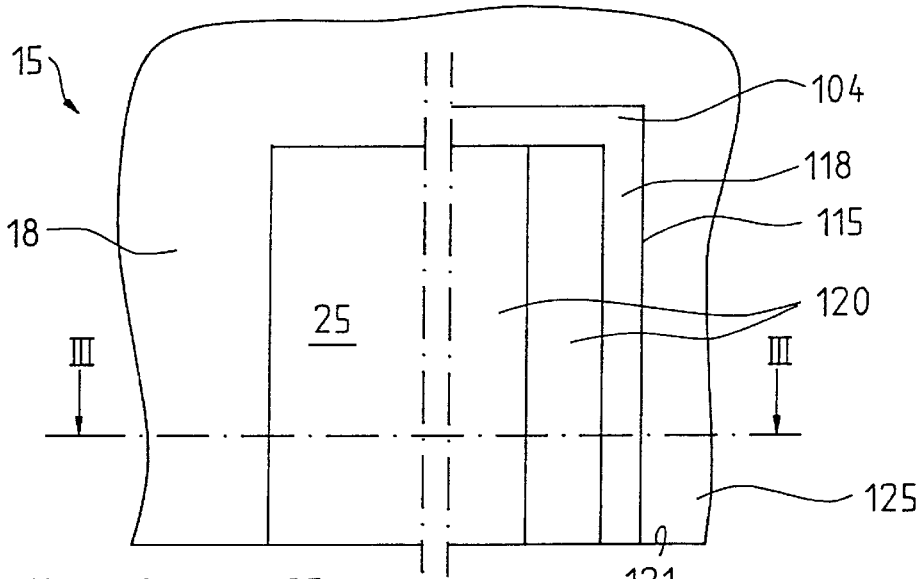
FIG. 2 is a front view elevation view showing side by side the hoistway walls and hoistway doors from FIG. 1.
Figure 3:
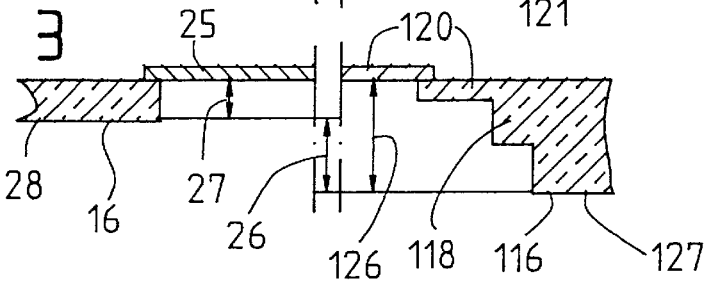
FIG. 3 is a sectional view of the hoistway walls and doors taken along the line III—III in FIG. 2.

In FIGS. 1–3 an elevator installation 1 according to the present invention and a conventional (prior art) elevator installation 101 are shown side by side. FIGS. 1 and 2 both show a movable elevator car 3, 103, which is guided in an elevator hoistway 2, 102 and caused to move vertically over several stories of a building by means of a drive not shown in greater detail, which car is shown here in position at a landing stop. In both installations 1, 101 the elevator car 3, 103 is equipped with a conventional center-opening 4-panel telescopic door 4, 104 which on the side facing hoistway doors 5, 105 is fastened to supporting elements of the elevator car structure and covers or uncovers a car opening 6, 106. The car door 4, 104 comprises a projecting sill plate 7, 107 on the underside of the elevator car 3, 103 with guiding devices 8, 108 for door panels 9, 109 which are horizontally displaceable by means of a door drive and guiding mechanism fastened to the upper edge of the car. At both sides of the elevator car 3, 103 free ends 10, 110 of the sill plate 7, 107 extend into the elevator hoistway 2, 102 by a lateral overtravel distance 11, 111 depending on the desired size of the car opening 6, 106.

In essence, the elevator hoistway 2, 102 has a rectangular cross sectional surface that is bounded on three sides by walls. Due to the clear distance between two side walls 13, 113 arranged parallel to each other, a hoistway width 12, 112 is equal to the length of the sill plate 7, 107 of the car door 4, 104 plus a lateral play 14, 114 to the wall 13, 113. In the exemplary embodiment shown in FIG. 1, the fourth side is bounded by a modular hoistway wall 40 (see FIGS. 6–7) described in more detail below consisting of hoistway wall modules 15 according to the invention placed vertically on top of each other and having integrated hoistway doors.

By contrast, the right-hand half of FIG. 1 shows a conventional construction in which a hoistway wall 116 forms the fourth side of the elevator hoistway 102. Anchored there in known manner in a hoistway door opening of the landing wall 116 is a door frame 115 (FIG. 2) of the four panel telescopic hoistway door assembly 105. In addition, two vertical side jambs 118 joined to each other above by a head jamb (not shown) are anchored by means of several anchor fastenings 117 in the landing wall 116, and a sill plate 119 joining the two side jambs 118 below is anchored in a recess on a landing floor 121 in the hoistway side. The hoistway door assembly 105 is set relative to the sill plate 119, and its position aligned to the landing floor 121 as well as relative to the elevator car 103. The sill plate 119, together with door panels 120 of the hoistway door 105 guided in it and their motive mechanism, projects into the hoistway 102 thereby bridging a gap 122 between the landing floor 121 and the car door 105. The sill plate 119 and the motive mechanism of the hoistway door 105 are the same length as the sill plate 107 and the door drive and guidance mechanism of the elevator car door 104. Furthermore, lateral overtravel distances 111, 123 correspond to the two door assemblies 104, 105. The overtravel distance 123 of the hoistway door assembly 105 is equal to the width of the door panels 120 provided, and is covered by the upright jambs 118 and landing wall 116 adjacent to the hoistway door opening. With the doors 104, 105 open, the end faces of the upright jambs 118, the door panels 109, 120, the hoistway door 105, the car door 104, and a car wall support 124 are flush with each other.

On the elevator installation 1 according to the present invention, as also already on conventional solutions, the gap between the car door sill 7, 107 and a respective hoistway door sill 17, 119 must be very accurately adjusted to ensure reliable coupling, i.e. engagement of the door drive mechanism on the car 3, 103 with the motive mechanism of the hoistway doors 5, 105 to unlock and move the hoistway door panels when the elevator car 3, 103 approaches the landing stop. On the building a facade cladding 18, 125 is applied to each respective hoistway wall 16, 116.

As shown in FIG. 1, according to the present invention the modular hoistway wall 40, specifically each individual hoistway wall module 15, is inserted in a hoistway door opening provided in the building. The hoistway door opening covers the entire hoistway width 12 and projects into recesses 20 which are formed in the lateral boundaries of the elevator hoistway 13, 16. Finally, on its side facing a landing floor 21, the hoistway wall module 15, which is anchored in position, is clad with the facade 18.

In this embodiment, the recesses 20 at the side of the elevator hoistway 2 are formed in the landing wall 16, and especially also in the landing floor 21, and create vertical grooves in the area between the side wall 13 and landing facade 18 running over and at the sides of the entire travel distance of the elevator car 3.

A depth 22 of the recess 20 corresponds to the depth dimension of the hoistway wall module 15 plus the width of the hoistway door sill plate 17 plus an adjustment dimension 23 allowed in the construction for aligning the hoistway wall module 15 with the integrated hoistway doors 5 relative to the car 3. In this depth of recess, the door guidance and motion mechanism of the hoistway doors 5 has adequate space.

With the constructionally specified dimension of the opening 6 for the hoistway door and car, a lateral width 24 of the recess 20 is generally given by the width of the largest hoistway door panel 9, 25 used in each case. Here, with the center opening 2-panel hoistway door 5 built into the hoistway wall module 15, the width of the two door panels 25 corresponds in each case to at least half the width of the car door opening 6 provided.

Showing the conventional method of construction of the hoistway closure, as well as according to the invention, side by side for comparison in FIG. 3 makes the saving in a depth dimension 26 clear. The hoistway wall module 15 shown in FIG. 3 has a depth dimension 27 which is equal to the sum of the depth of the module 15 and the depth of the facade 18. On the other hand, the conventional hoistway closure consisting of hoistway wall 116 and inserted or stacked hoistway door assemblies 118, 120 takes up a much greater dimension 126 in the building, measured in each case as the distance from the facade edge 28, 127 to the door panel 25, 120 of the hoistway door 5, 105. In FIG. 1 the landing wall 16 formed by the hoistway wall module 15 is moved toward the hoistway 2 to correspond to the saving in depth 27 according to the invention. In particular, according to the invention the doorframe 115 required hitherto and shown in the right hand side of FIG. 2 is not required. As a result, the facade cladding 18 as shown in FIG. 2 extends directly up to the hoistway door cutout. The frameless construction of the hoistway wall module 15 according to the invention therefore makes it possible to provide landing wall and hoistway wall cladding corresponding to any wishes regarding finish in a wide range. In particular, a door wall module according to the invention with built-in single-panel hoistway door fulfills high aesthetic requirements. There are practically no restrictions regarding architectural design wishes. The cladding can take the form of metal, stone, tiles, or wood. For reasons of safety, only non-combustible or flame resistant materials with sufficient fire resistance can be used. If desired, the frameless construction of the hoistway wall module 15 without a door frame according to the invention can be provided with a facing 29 along the hoistway door cutout, as shown by way of example in the embodiment in FIG. 1.

The facing 29 can be made from metal in the form of an edge a few centimeters wide of the module 15, as in FIG. 1, or also from the same materials as the landing facade mentioned above. In an optically attractive embodiment it is foreseen that refractive glass or transparent, possibly colored, plastic materials are used which together with one or more discreet light sources make the hoistway door cutout appear optically attractive.

Figure 4:
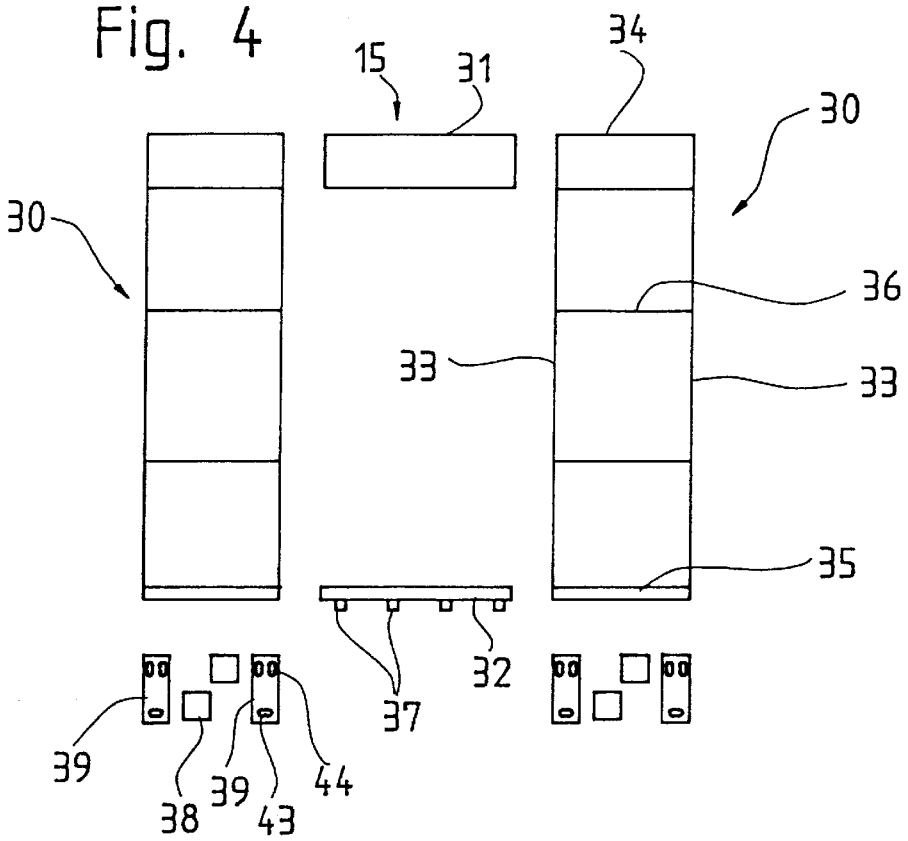
FIG. 4 is an exploded view of the construction of the first embodiment of the hoistway wall module according to the present invention.

The hoistway module 15 described in FIG. 1 is a metal construction built as shown in FIG. 4 in which two flat, wide side assemblies 30 are joined above by a lintel assembly 31 and below by a connecting section 32. FIG. 4 shows side assemblies 30 which, in each case are assembled from vertical rectangular tubes 33 which at their upper end are joined by a double web 34, at the lower end by a shaped sheet 35, as well as two transverse tubes 36 arranged at equal distances between them. The length and height of the side assembly 30 corresponds to at least the height of the respective story, its width to the width foreseen for the hoistway wall panel to be created. The lintel assembly 31 is also a frame construction assembled from rectangular tubes, whose width corresponds to the size of the hoistway door opening and whose height forms the upper boundary of the hoistway door opening. The connecting section 32 is an extruded L-section to the underside of which projecting sill support plates 37 are welded at equal distances to fasten the hoistway doorsill 17. A suitable pattern of drilled holes formed in the double webs 34 and lintel assembly 31 ensures simple, accurately positioned installation of the motive mechanism of the hoistway door panels 9.

Serving to connect the individual hoistway wall modules 15 to each other, and the modular hoistway wall 40 with the building, there are adjusting tubes 38 which terminate at a fastening plate 39 which is itself anchored in the landing floor 21.

Figure 5:
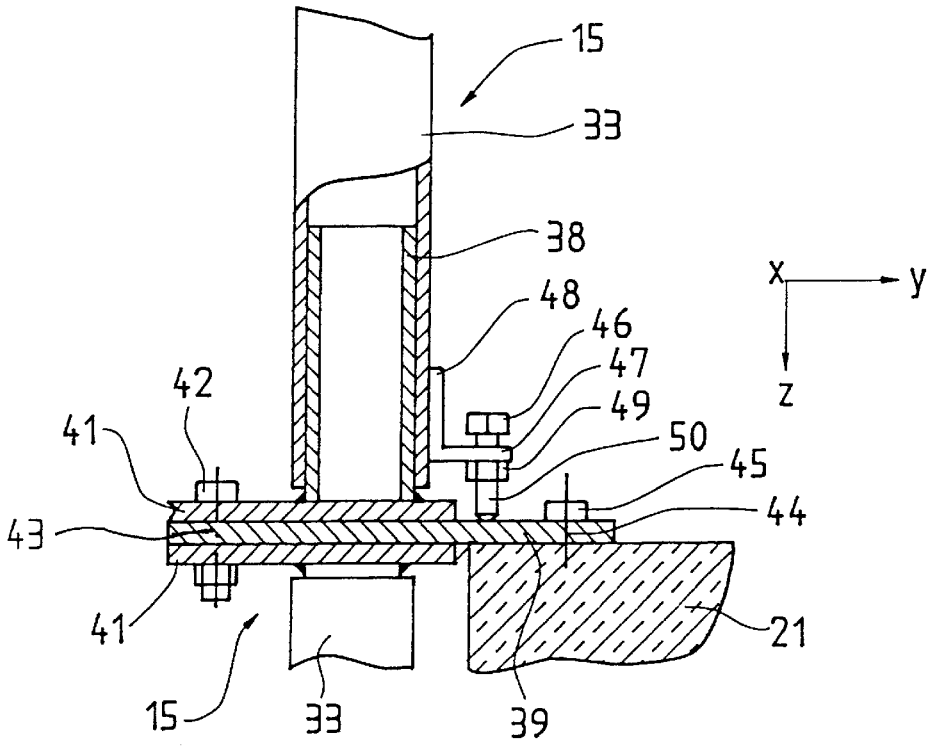
FIG. 5 is an enlarged partial section of the point of connection and fastening between two hoistway wall modules containing the adjusting screw from FIG. 4.
Figure 6:
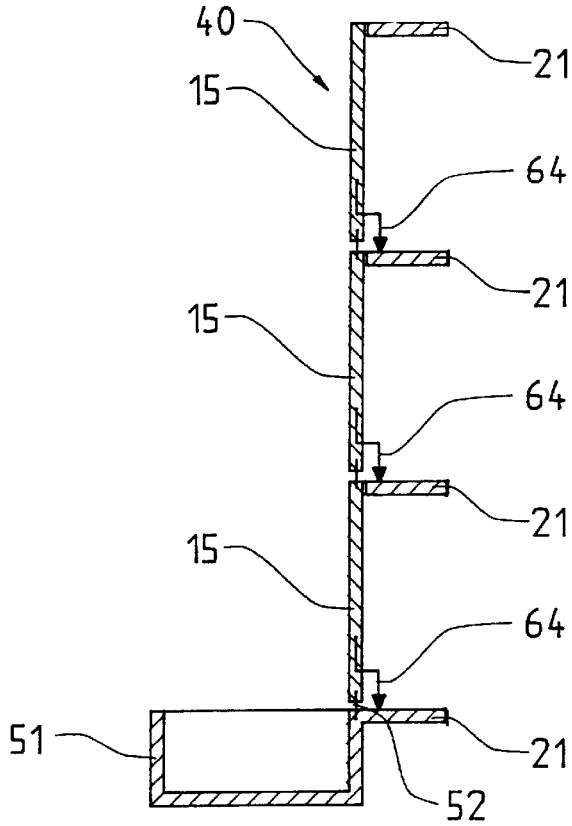
FIG. 6 is a sectional view of the first embodiment of the modular hoistway wall of the elevator installation according to the present invention.

In FIG. 5 an enlarged partial section of the connection and fastening point of two hoistway wall modules 15 is shown which has vertical force transmission 64 individual to each floor as shown by way of example in FIG. 6. The individual vertically stacked hoistway modules 15 are aligned flush relative to each other in the vertical direction by the vertical tube 33, here taking the form of a rectangular tube, which in each case is set into the open end faces of the adjusting tube 38 and can be axially adjusted in it. Welded onto the end face of the adjusting tube 38 which extends beyond the rectangular tube, perpendicular to the longitudinal axis of the tube and laterally offset, is a rectangular installation plate 41. The installation plate 41 lies flat on the fastening plate 39 and is fastened to this and held in position by means of a screw 42. Correspondingly, the installation plate 41 of the hoistway module 15 underneath is guided from below toward the fastening plate 39 and fastened to it. Oval holes 43 in the fastening plate 39 permit alignment in the x-direction, whereas the fastening plate 39 has oval holes 44 with y-orientation at its end toward the building which allow its corresponding alignment in the y-direction, i.e. the distance between the modular hoistway wall 40 and the landing floor 21, before it is fixed with a screw 45.

Adjusting tube 38 and fastening plate 39 serve exclusively for adjustment in the x and y directions. No forces in the z-/vertical direction are absorbed by the linear direction represented as adjusting tube 38. The vertical force transmission 64 and adjustment in the z-direction take place by means of an adjustment screw 46 at the respective lower end of the vertical tube 33. The adjustment screw 46 is held in a nut thread 47 of a permanently attached angle 48 and can be screwed in the z-direction. A threaded end 50 of the adjustment screw 46 rests on the fastening plate 39 in the area of the landing floor 21. In this manner, when the adjustment screw 46 is turned, the hoistway wall module 15 moves in the z-direction relative to the landing floor 21. The length of adjusting tube 38 can be adapted to the thickness of the respective landing floor, to ensure flush alignment of the hoistway modules 15 relative to each other. Irrespective of the distance available for movement, the adjustment length in the z-direction is given by the length of the threaded end 50. A locknut 49 serves to secure it in place.

Figure 7:
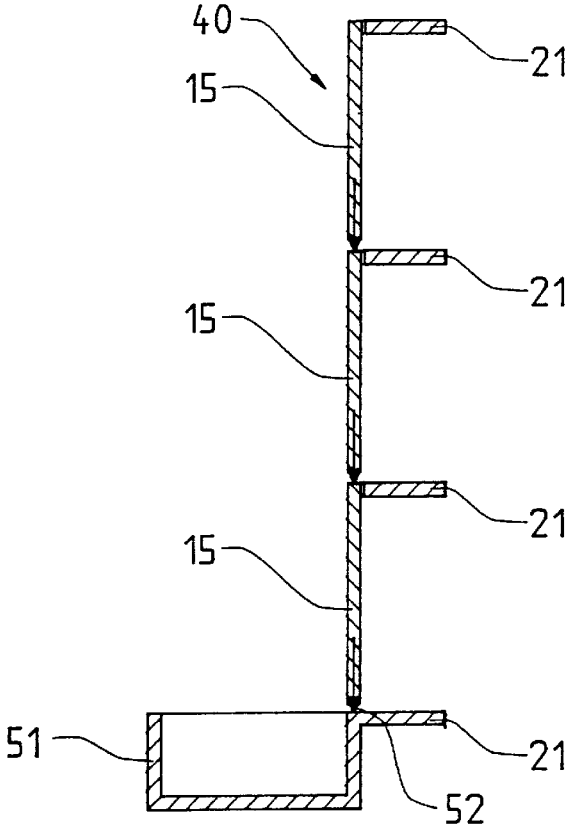
FIG. 7 is a sectional view of a second embodiment of the modular hoistway wall of the elevator installation according to the present invention.
Figure 8:
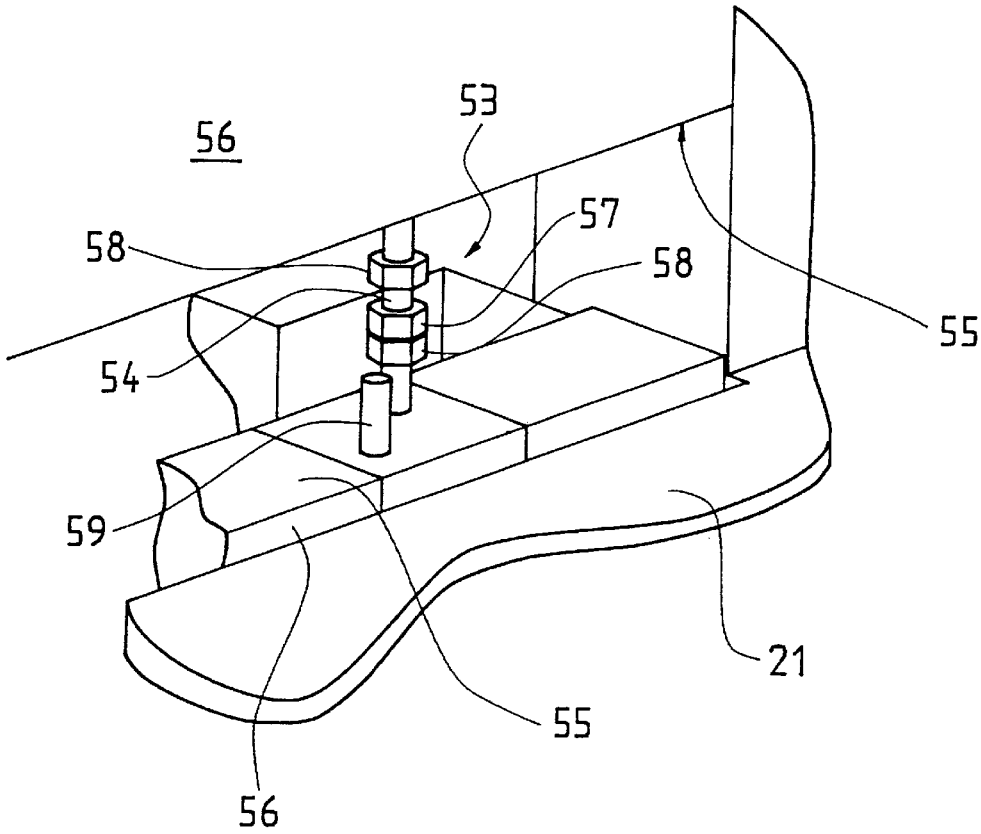
FIG. 8 is an enlarged perspective view of the connection and fastening device of two hoistway wall modules in FIG. 7.

In the embodiment according to FIG. 7, the modular hoistway wall 40 rests in a self-supporting manner on a hoistway pit module 51, which by means of integrated reference points 52 defines the exact position of the hoistway wall 40. Independent of a hoistway wall embodiment 40 which is self-supporting, or supported on each individual floor, the hoistway pit module 51 is delivered to the job site in the form of a pan, e.g. of reinforced concrete, and lowered into a pit prepared for it in the desired position on the job site. Unlike the embodiment described in FIG. 6, the entire weight of the hoistway wall 40 rests on the hoistway pit module 51. As a result, the hoistway wall 40 is an almost freestanding interface of the elevator installation to the building. The only connectors are fastening plates anchored on the landing floors. Through these there is transmission of force exclusively in the y-direction to adjust the hoistway wall 40 relative to the building, or the hoistway doors 5 relative to the door drive mechanism of the elevator car door 4. Through fastening devices 53 shown in FIG. 8, forces in the z-direction are cumulatively transmitted into the elevator foundation, i.e. the hoistway pit module 51. A threaded stud 54, with threads running in opposite directions to its ends provides a means of alignment in the z-direction. The ends of the threaded stud 54 are also screwed into the respective faces 55 of two hoistway wall modules 56 that are to be fastened on top of each other. A screw nut 57 fixed at the midpoint of the threaded stud 54, and two free-running adjusting nuts 58, form points of application for a tool to adjust the positions of the hoistway wall modules 56 relative to each other. The threaded stud 54 is complemented in its function by a guide pin 59 projecting from the upper face of the hoistway module 56. The guide pin as alignment guide in the z-direction fits into the lower end face 55 of the hoistway wall module 15, or more specifically into the fastening device located there.

The self-supporting construction of the hoistway wall modules 15, 56 has the advantage that fewer fastening anchors are required in total, and specifically in the landing walls none, and that for this reason there is no longer any structure-borne transmission of noise from the door mechanism and door drive to the building.

Figure 9:
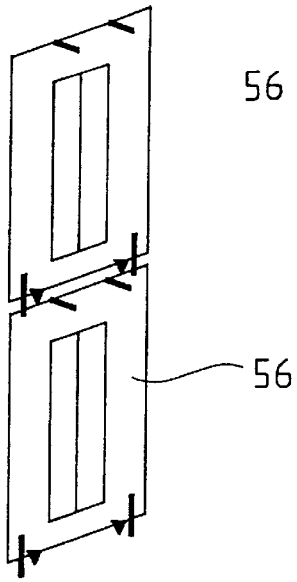
FIG. 9 is a diagrammatic view of the installation of part of a modular hoistway wall system according to the present invention.
Figure 10:
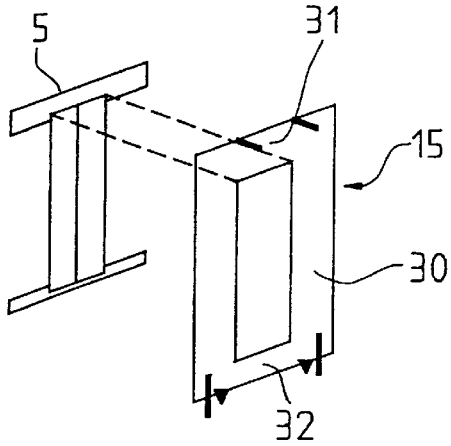
FIG. 10 is a diagrammatic view of installation of a module.

The hoistway wall modules 15, 56 are either completely preassembled, as in FIG. 9, or else, as in the example of the built embodiment 15 described so far, the individual assemblies are taken to the job site and then assembled there. In the latter case, subsequent integration of the hoistway door assembly 5 can be easily effected as shown diagrammatically in FIG. 10.

Figure 11:
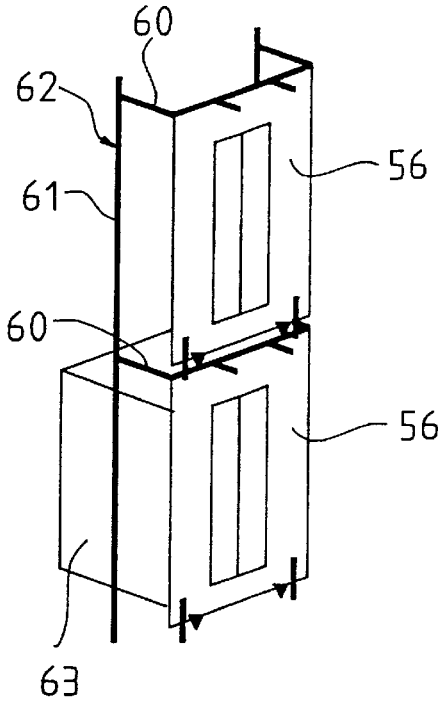
FIG. 11 is a diagrammatic view of installation of a hoistway wall system for the example of an autonomous elevator installation.

In FIG. 11, hoistway wall modules 15, 56 according to the present invention are preassembled with each other to form the hoistway wall 40, and the hoistway wall 40 thereby created is preassembled in its totality on supporting frames 60 on the guiding devices for the elevator car 63 or on load-bearing columns 61 of an autonomous self-supporting elevator installation 62 with an elevator car 63 to form a complete elevator system.

The assembled embodiment of the hoistway wall module 15 according to the invention provides the possibility of inserting the hoistway wall module 15 first alone, i.e. without hoistway door assembly 5, into the hoistway opening provided in the building and fastening it there while the building is still under construction. The hoistway wall module then already serves as a safety barrier. As building continues, the hoistway door assembly can be subsequently built in from the interior of the hoistway, while a facade construction worker simultaneously installs the desired landing facade on the hoistway wall module from the building side.

Figure 12:
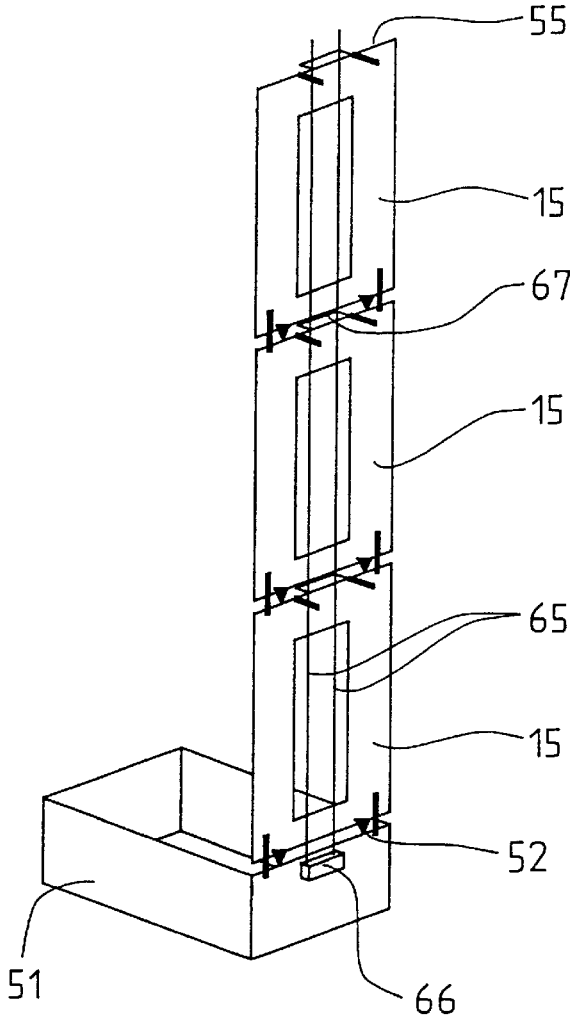
FIG. 12 is a diagrammatic view of laser-supported alignment of the modular hoistway wall.

FIG. 12 shows diagrammatically the method already known in itself of aligning the individual hoistway wall modules 15, 56 flush above each other, and in the position given by the reference points 52 of the hoistway pit module 51, with the assistance of two laser beams 65 of a laser canon 66 or laser adjusting instrument. The laser beams 65 give the bearing along which target plates 67 on each hoistway wall module 15 are aligned during installation of the hoistway wall modules 15. In this connection, as already described above, on hoistway wall modules 15, 56 according to the invention, the fastening points/fastening elements situated exclusively in the middle of the face 55 of each module 15, 56 provide the possibility that the laser canon can be placed in a conveniently accessible position, and the doors 5 adjusted and aligned to correspond to the laser beams 65 along the height of the hoistway installation. The reference position of the laser adjusting instrument 65, 66, 67 is thereby already provided in the construction of the hoistway wall module. If necessary with multistory hoistway installations, the laser canon 66 can possibly be moved from floor to floor several times without causing inadmissible dimensional deviations.

Figure 13:
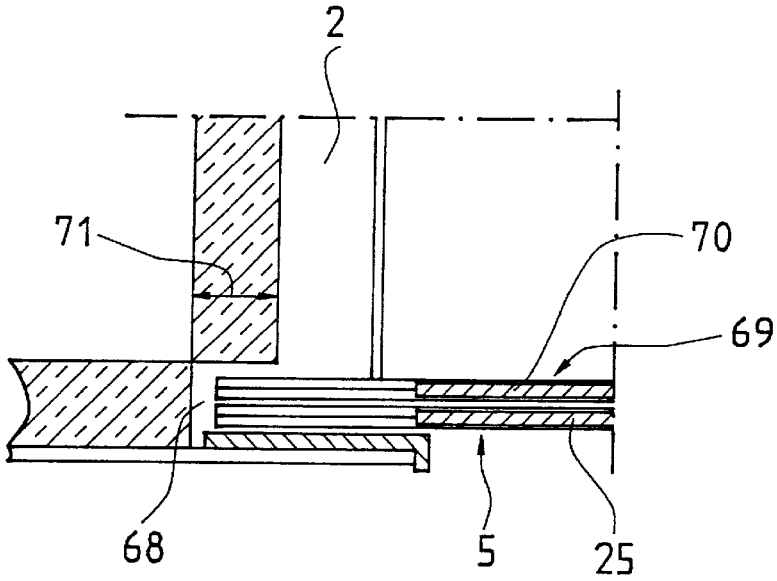
FIG. 13 is a partial sectional view of a second exemplary embodiment of the elevator installation according to the present invention.

FIG. 13 shows an exemplary embodiment of the invention in which, over and above the embodiment according to FIGS. 1, 2, and 3, as well as the hoistway door 5 the elevator car door 69 can also be displaced into recesses 68 at the side of the elevator hoistway 2. The recess space corresponding to the building volume of the door assemblies is again provided in the building structure. The car door 69 and the hoistway door 5 take the form of a center opening 2-panel door. According to the invention, the width of the individual door panels 25, 70 can be selected to be greater than hitherto. As a result, a significantly larger car entrance opening can now be provided by means of a less elaborate 2-panel door.

Furthermore, a greater length of door displacement 71 provided according to the present invention makes it possible to dispense with car wall supports 124 (shown in FIG. 1) which usually bound the car entrance opening at the side on the side of an elevator car 72 (shown in FIG. 14) facing the hoistway door 5. The car entrance opening is bounded by the car sidewalls 73, and when the car door 69 is opened, the door panels 70 are displaced laterally until they are in a position flush with the sidewalls 73 of the car.

Figure 14:
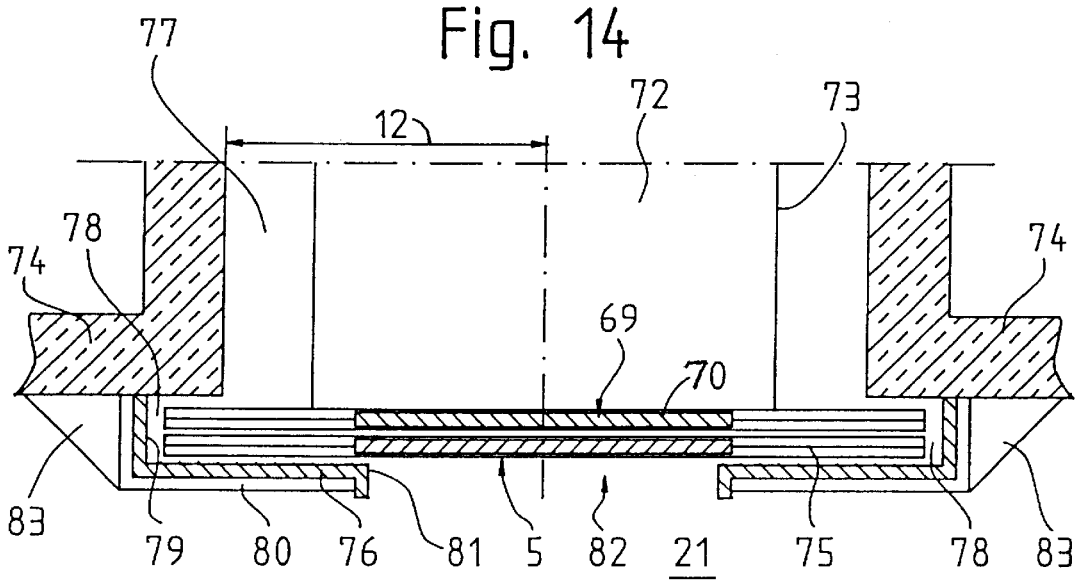
FIG. 14 is a partial sectional view of a third exemplary embodiment of the elevator installation according to the present invention with a hoistway wall module in place.

The embodiment of the present invention according to FIG. 14 corresponds as regards elevator hoistway width 12, elevator car 72, car door 69 construction, and hoistway door 5 construction, to the elevator installation described in FIG. 13. The difference between the two is that a landing wall 74 is transferred at least as far behind a sill plate 75 of the elevator car 72. A hoistway wall module 76 with integrated center-opening 2-panel door 5 is fastened to the landing wall 74 from the building side and covers a hoistway 77 toward the building. The hoistway wall module 76, or the modularly constructed hoistway wall 40, is thereby transferred completely out of the elevator hoistway 77 into the building. Corresponding recesses 78 in the landing floor 21, which extend beyond the side boundaries of the hoistway, provide a track for the elevator car door assembly over all stories. At the same time, the recesses 78 correspond to the installation dimensions of the hoistway wall module 76, so that the modular hoistway wall, which is independent between the hoistway pit module 51 and the upper end of the car travel, experiences guidance by the recesses 78. Here, the hoistway wall modules 76 comprise a shaped steel plate with a hoistway door opening 82 and folded side edges 79. The extent of the side edges 79 corresponds to the depth dimension of the hoistway door 5 which is integrated into them and the car door 69 running in them. On the building side, the shaped steel plate is clad with a desired facade 80. A fold 81 over the perimeter of the hoistway door opening 82 forms an optically attractive surround at which the facade 80 terminates on its face side. On the building side, luminaires 83 are arranged on a projection formed by the side edges 79 and emphasize an attractive appearance of the modular hoistway wall 76 and the hoistway entrance area. Moreover, for advertising purposes, the luminaires 83 can be screened in a suitable manner with transparent covers carrying advertisements.

Figure 15:
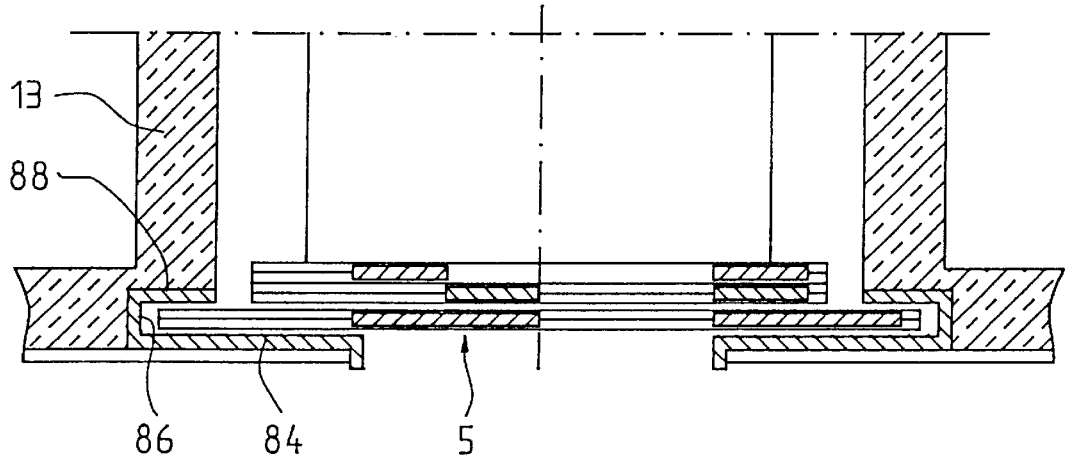
FIG. 15 is a partial section of a fourth exemplary embodiment of the elevator installation according to the present invention.
Figure 16:
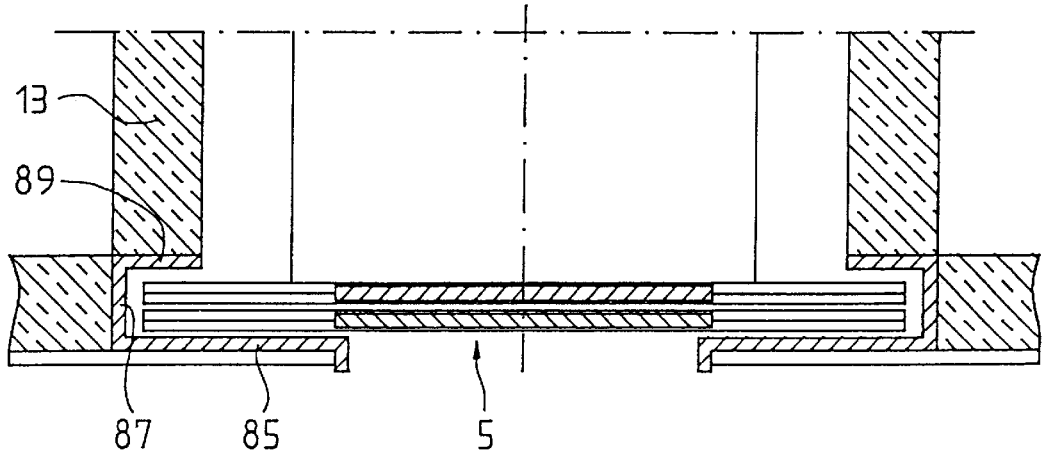
FIG. 16 is a partial sectional view of a fifth exemplary embodiment of the elevator installation according to the present invention.

Finally, in FIGS. 15 and 16 two embodiments of the invention are shown in which a hoistway wall module 84, 85, as previously in FIG. 14, takes the form of a shaped steel plate with folded sidewalls 86, 87 at the sides. The outer ends of the side edges 86, 87 are also folded and form preferably unshaped side edges on both sides of the hoistway wall module 84, 85. In these unshaped side edges the hoistway door assembly 5, and especially the ends of the sill plate 17, as well as the door guiding and motive mechanism, are embedded safely and well-protected from damage during transportation to the job site and until installation is complete. A folding 88, 89 of the side edges 86, 87 acts as a stiffener for the hoistway module structure and permits easy abutment of the module 84, 85 to the side wall of the hoistway.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A hoistway wall module for covering a hoistway door opening of an elevator hoistway in a building, the elevator hoistway having a pair of side walls spaced a predetermined distance apart defining the hoistway width, comprising:

a frame formed by a pair of spaced upright side assemblies defining opposite side edges of said frame, said side assemblies being joined at top ends by a lintel assembly and joined at bottom ends by a connecting section, a hoistway entrance opening formed in said frame, said frame having a width between said side edges greater than the predetermined distance between the elevator hoistway side walls, said frame having a surface adapted to face the hoistway door opening, said frame being adapted to be received in a vertically extending recess formed in a landing wall adjacent each of the elevator hoistway side walls of the hoistway door opening; and at least one door panel mounted on said frame surface and being horizontally displaceable between a closed position covering said hoistway entrance opening and an open position uncovering said hoistway entrance opening, said frame and said one door panel forming the hoistway wall module, whereby when the hoistway door module is installed to cover the hoistway door opening, in said open position said one door panel does not extend beyond an adjacent one of said side edges of said frame and does extend at least partially beyond the hoistway width.

2. The hoistway wall module according to claim 1 wherein a height of said side assemblies corresponds to a distance between adjacent floors in a building in which said hoistway wall module is to be installed.

3. The hoistway wall module according to claim 1 including a facade cladding attached to a front surface of said frame.

4. The hoistway wall module according to claim 1 wherein said side assemblies each include a side edge and a fold adapted to be received in the recess when said frame is mounted at the hoistway door opening.

5. The hoistway wall module according to claim 1 wherein at least a portion of said one door panel is received in the recess when said frame is mounted at the hoistway door opening.

6. The hoistway wall module according to claim 1 wherein at least a portion of said one door panel and at least a portion of an elevator car door are received in the recess when said frame is mounted at the hoistway door opening and an elevator car having the car door is positioned at the hoistway door opening.

7. The hoistway wall module according to claim 7 wherein said frame is adapted to be mounted on a landing wall adjacent each of the elevator hoistway side walls of the hoistway door opening.

8. A hoistway wall module for covering a hoistway door opening of an elevator hoistway in a building, the elevator hoistway having a pair of side walls spaced a predetermined distance apart defining the hoistway width, comprising:

a frame formed by a pair of spaced upright side assemblies defining opposite side edges of said frame, said side assemblies being joined at top ends by a lintel assembly and joined at bottom ends by a connecting section, a hoistway entrance opening formed in said frame, said frame having a width between said side edges greater than the predetermined distance between the elevator hoistway side walls, said frame having a surface adapted to face the hoistway door opening at least one door panel mounted on said frame surface and being horizontally displaceable between a closed position covering said hoistway entrance opening and an open position uncovering said hoistway entrance opening, said frame and said one door panel forming the hoistway wall module, whereby when the hoistway door module is installed to cover the hoistway door opening, in said open position said one door panel does not extend beyond an adjacent one of said side edges of said frame and does extend at least partially beyond the hoistway width; and at least one fastening means coupled to each of said side assemblies, said fastening means being adapted to be attached to a landing floor adjacent to the hoistway door opening to permit vertical movement of an associated one of said side assemblies relative to the landing floor.

9. The hoistway wall module according to claim 8 wherein said side assemblies each include a side edge and including a luminaire mounted on each of said side edges.

10. The hoistway wall module according to claim 8 wherein each said fastening means includes an adjustment means for moving said associated one of said side assemblies relative to the landing floor.

11. A modular hoistway wall for covering hoistway door openings of an elevator hoistway in a building, the elevator hoistway having a pair of side walls spaced a predetermined distance apart defining the hoistway width, comprising:

at least two frames each formed by a pair of spaced upright side assemblies defining opposite side edges of said frames, said side assemblies being joined at top ends by a lintel assembly and joined at bottom ends by a connecting section, a hoistway entrance opening formed in each of said frames, said frames having a width between said side edges greater than the predetermined distance between the elevator hoistway side walls, each said frame being adapted to be received in a vertically extending recess formed in a landing wall adjacent each of the elevator hoistway side walls of the hoistway door opening; and fastening means attaching said lintel assembly of one of said frames to said connecting section of another of said frames to form the modular hoistway wall and for moving said frames relative to each other.

12. The modular hoistway wall according to claim 11 wherein a height of said side assemblies corresponds to a distance between adjacent floors in a building in which said modular hoistway wall is to be installed.

13. The modular hoistway wall according to claim 11 including a hoistway pit module supporting said frames.

14. The modular hoistway wall according to claim 13 wherein said hoistway pit module includes at least one reference point defining an exact position for mounting said frames and said frames each include at least one target plate for aligning with said at least one reference point during installation of the modular hoistway wall.

15. The modular hoistway wall according to claim 11 wherein said frames are joined together to form a self-supporting construction independent of a building structure.

16. The modular hoistway wall according to claim 11 wherein each said frame includes fastening means for attachment to a respective landing floor of a building.

17. A modular hoistway wall for covering hoistway door openings of an elevator hoistway in a building, the elevator hoistway having a pair of side walls spaced a predetermined distance apart defining the hoistway width, comprising:

at least two frames each formed by a pair of spaced upright side assemblies defining opposite side edges of said frames, said side assemblies being joined at top ends by a lintel assembly and joined at bottom ends by a connecting section, a hoistway entrance opening formed in each of said frames, said frames each having a width between said side edges greater than the predetermined distance between the elevator hoistway side walls and a surface adapted to face the hoistway door opening, each said frame being adapted to be received in a vertically extending recess formed in a landing wall adjacent each of the elevator hoistway side walls of the hoistway door opening; and at least one door panel mounted on each said frame surface and being horizontally displaceable between a closed position covering said hoistway entrance opening and an open position uncovering said hoistway entrance opening, said frames being attached together to form the modular hoistway wall, whereby in said open position each said one door panel does not extend beyond an adjacent one of said side edges of said frame on which said one door panel is mounted and does extend at least partially beyond the hoistway width.

18. The modular hoistway wall according to claim 17 including fastening means attaching said lintel assembly of one of said frames to said connecting section of another of said frames and for moving said frames relative to each other.

* * * * *